United States Patent [19]

Maynard

[11] Patent Number: 4,776,555

[45] Date of Patent: Oct. 11, 1988

[54] CONCRETE FORMING DEVICE

[75] Inventor: Robert D. Maynard, Mantua, Ohio

[73] Assignee: Tyco Forms, Inc., Akron, Ohio

[21] Appl. No.: 9,626

[22] Filed: Jan. 23, 1987

[51] Int. Cl.[4] ..... E01C 19/50

[52] U.S. Cl. ..... 249/6; 249/7; 249/134; 249/193

[58] Field of Search ..... 249/2–8, 249/134, 189, 192, 193, 194

[56] References Cited

U.S. PATENT DOCUMENTS

| | | | |
|---|---|---|---|
| 2,611,169 | 9/1952 | Torrelli | 249/4 |
| 3,124,858 | 3/1964 | Blonde | 249/193 |
| 3,136,023 | 6/1964 | Von Drasek | 249/6 |
| 3,295,818 | 1/1967 | Kreier, Jr. | 249/134 |
| 3,381,929 | 5/1968 | Bancker | 249/5 |
| 3,475,265 | 10/1969 | Santry | 249/134 |
| 3,479,786 | 11/1969 | Kreier, Jr. | 249/134 |
| 3,669,401 | 6/1972 | Nevarez | 249/134 |
| 3,778,019 | 12/1973 | Stegmeier | 249/2 |
| 4,340,200 | 7/1982 | Stegmeier | 249/3 |
| 4,579,312 | 4/1986 | White | 249/6 |

FOREIGN PATENT DOCUMENTS

| | | | |
|---|---|---|---|
| 402190 | 2/1943 | Italy | 249/192 |
| 8402943 | 8/1984 | PCT Int'l Appl. | 249/193 |

*Primary Examiner*—Jay H. Woo
*Assistant Examiner*—James C. Housel
*Attorney, Agent, or Firm*—Oldham & Oldham Co.

[57] ABSTRACT

A concrete forming device made from plastic components which can be assembled in the location of use to form a desired shape and fastened to the ground with steel stakes driven through brackets attached to components. After use, the stakes are removed and the components disassembled for use elsewhere. Desirably, the components are formed from fiberglass reinforced resins and additives of a type which impart a surface to the components of such a nature as to have little tendency to adhere to the concrete. This makes it easy to remove the components and to reuse them without cleaning. The components are constructed with suitable adaptors and couplers so that assembly can be accomplished by merely inserting male parts into female parts in a slip fit relationship. Both straight and curved shapes can be formed, as well as shapes that have both straight and curved elements.

8 Claims, 3 Drawing Sheets

FIG.-1
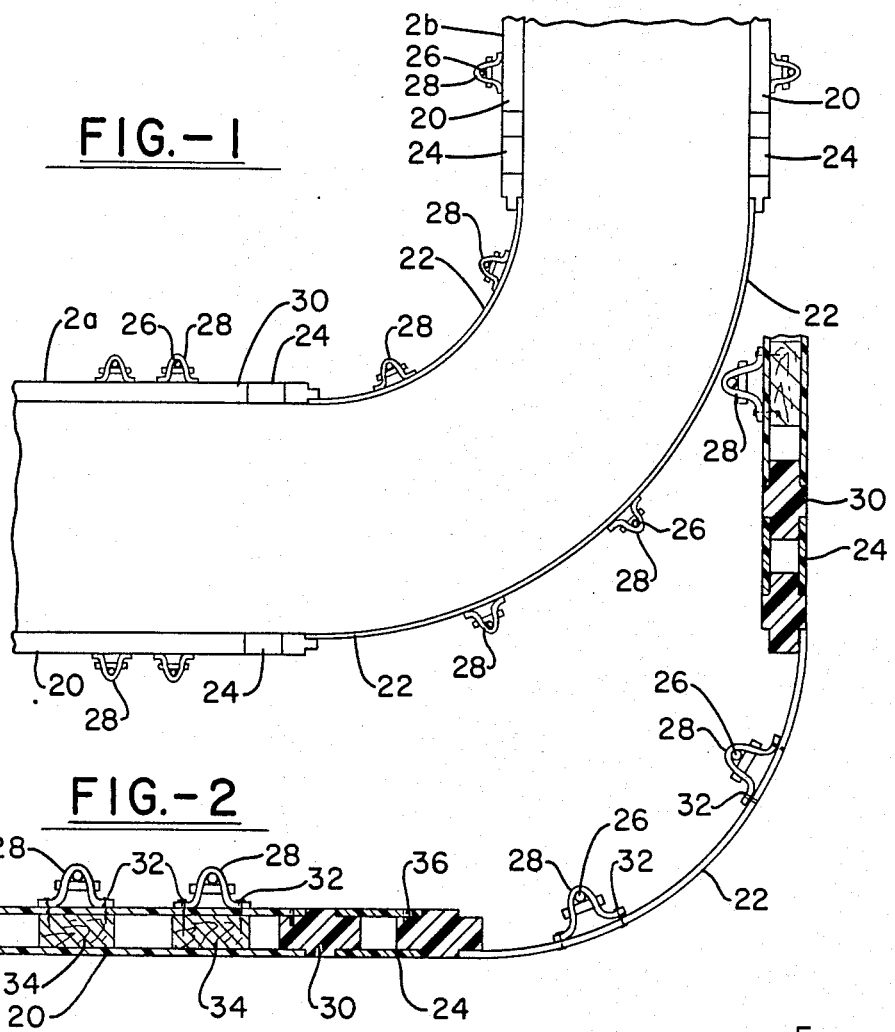
FIG.-2
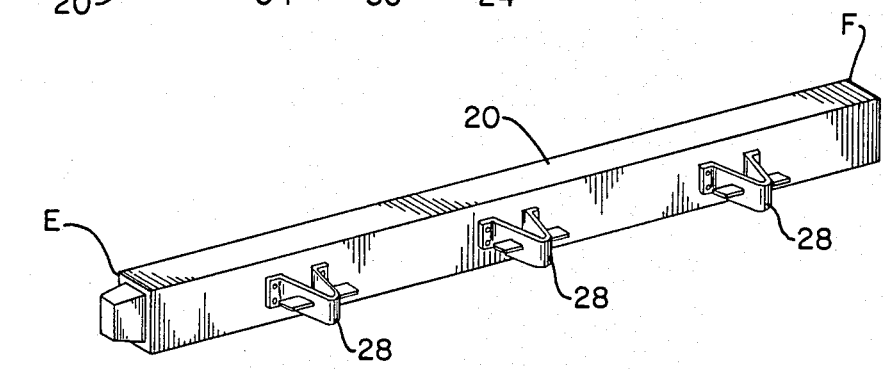
FIG.-3

CONCRETE FORMING DEVICE

This is a continuation of application Ser. No. 768,459, filed Aug. 22, 1985, abandoned.

BACKGROUND OF THE INVENTION

The invention is directed to a structural device for use in forming concrete into desired shapes. More specifically, the invention is directed to a concrete forming device which can be assembled from component parts at a particular location, used to impart the desired shape to a semi-fluid concrete mixture, removed when the concrete has set, disassembled and moved to a new location of use.

As is well known, freshly mixed concrete must be retained in some type of forming device until it has hardened or "set" if it is to achieve the structural shape desired by the user. A number of methods in the past have been employed to do this.

Commonly, forms are constructed from wood. Such material is reasonably inexpensive, and it is relatively easy to install. However, wooden forms are porous and frequently have rough surfaces. These factors create a tendency for concrete to adhere to the forms, not only sometimes making it difficult to remove them after the concrete has set, but also making it hard to reuse the form material, since portions of the surface often become partially coated with hardened cement. The need to frequently replace the forms, and the effort required to dissassemble and remove them, creates an appreciable expense over time.

Removable steel forms have also been proposed. Unfortunately, however, steel forms have the same tendency to adhere to concrete that wooden forms have. Since they are expensive they cannot be discarded, but must be cleaned for reuse, a time consuming, costly process. Furthermore, metal objects heat rapidly in the sun, making it hard to handle the forms without severe discomfort. Steel forms are also heavy, hard to handle, and their method of installation is often relatively intricate.

Now however, a concrete forming device has been devised which has little tendency to adhere to concrete, making it easy to both remove the forms and reuse them without further preparation. The device is lightweight and durable, and can be used repeatedly with great ease. The forming device is cool to the touch, even after lying in strong sunlight for prolonged periods, and therefore comfortable to work with. It is easily and quickly assembled, disassembled, and transported. It can be permanently colored in bright, readily visable colors, assuring its easy visability, resulting in increased safety. The concrete forming device hereinafter described is particularly useful in constructing concrete slabs, such as for example those making up sidewalks, patios, driveways and similar objects.

BRIEF DESCRIPTION OF THE INVENTION

These and other desirable characteristics, as will be evident from the remainder of the specification, are achieved in a concrete forming device which comprises:

concrete forming plastic members, means for coupling such members together to produce a concrete form of the desired size and shape, and means for fastening such device securely in its position of use.

In a preferred embodiment, the coupling means consists of an object having two male ends, one end of which is fastened to a concrete forming plastic member, and the other end of which is designed to fit into the female part of an adjoining concrete forming plastic member. Further, the concrete forming plastic members have affixed to them means to fasten such members firmly to the ground with stakes.

In the illustrative embodiment, the straight form members of the concrete forming device comprise a plastic tube of rectangular cross section, into one end of which is inserted and fastened one end of a plastic coupling adapter which is constructed to have two male ends. Affixed to the tubes at intervals are metal stake brackets designed to accommodate and lock into place a stake driven through the bracket and into the ground, securely fastening the tube to the ground.

Where a curved shape is required, the members of the concrete forming device comprise a plain radius form having a thin, flexible cross section, enabling it to be easily bent to the desired curvature, and having a cross sectional height equal to the cross sectional height of the straight member. Coupling adaptors are fastened at both ends of the radius form, and as in the case of the straight members, metal stake brackets are affixed to the radius form at intervals. In instances where it is desired to fasten two radius forms together the projecting male ends of their respective coupling adaptors are inserted into a radius coupler member which comprises a short piece of rectangular plastic tube having the same cross sectional dimensions as that of the straight members. The complete form is assembled from its component members by inserting the male end of a respective member into the corresponding female end of an adjacent member until the desired shape is achieved, and then fastening the form members to the ground by driving metal stakes through their brackets into the ground.

BRIEF DESCRIPTION OF THE DRAWINGS

This invention will be better understood when taken in conjunction with the drawings wherein:

FIG. 1 is a plan view of an illustrative embodiment of the invention;

FIG. 2 is a horizontal section between two points 2(*a*) and 2(*b*) of FIG. 1;

FIG. 3 is a perspective view of a straight form member;

BEST MODE FOR CARRYING OUT THE INVENTION

Figure 4:
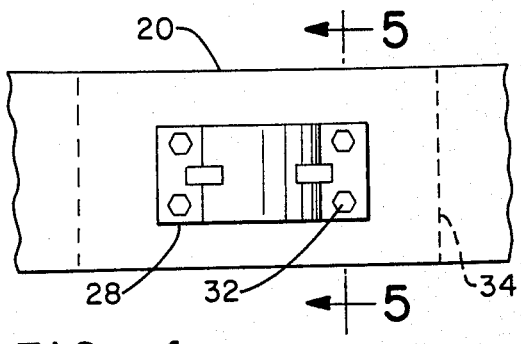
FIG. 4 is a side view of an illustrative metal stake bracket as shown in FIG. 3.

FIG. 1 shows the concrete forming device of the invention deployed in a configuration useful for construction of a sidewalk. The forms consist of straight form members 20 connected to radius forms 22 by means of radius couplers 24. The forming device is fastened to the ground by steel stakes 26, driven through steel stake brackets 28. In the process of assembly, the unattached male ends of the coupling adaptors of the form members are inserted into female ends of adjacent members to produce the desired form configuration. Stakes are then used to fasten the integral form to the ground. Following the assembly described, the concrete is poured into the form device and allowed to set. The stakes are then removed, the component members are pulled apart, and are found to be in condition for reuse elsewhere.

FIG. 2 shows how coupling adapters 30 are attached to members by fasteners, such as for example, rivets 32. Also shown is the method used in the preferred embodiment of the invention of fastening the stake brackets 28 to straight form members 20 by means of fasteners, for example, screws 32 extending through the bracket into wooden blocks 34, preferably of a hardwood variety. Stake brackets are fastened to radius form 22 by means of fasteners such as rivets 32. The adjacent form parts are connected by inserting male adaptor ends into member female ends to form slip fit joints 36, either with straight members 20, or radius couplers 24, as the case may be.

FIG. 3 shows a straight member 20 with a male end E, and a female end F. Disposed along the length of the member are three stake brackets 28. The number of brackets can be varied depending on the length of the member, which can also vary.

FIG. 4 shows a portion of a straight member 20, with an attached stake bracket 28. The bracket is attached to the member by means of screws 32 extending through the member into a wood block 34 inside the member. The length of the block can also be varied, it only being necessary that it be long enough to secure the screws used to affix the bracket. Alternatively, the brackets could be mounted by means of rivets; however, wood is preferred because of the additional strength it imparts to the attachment.

Figure 5:
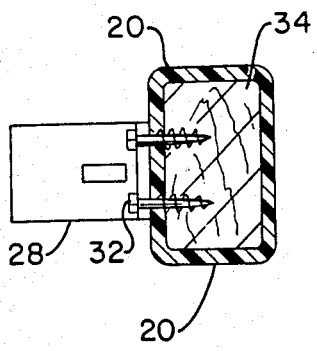
FIG. 5 is a transverse section through 5—5 of the metal stake bracket of FIG. 4.

FIG. 5 is a sectional view of the FIG. 4 stake bracket 28 along line 5—5 showing mounting details including the screws 32 extending through the bracket and the rectangular tube portion of the member 20 into the wooden block 34. It will be understood that the type of bracket employed can be varied from that shown, as can its method of affixation.

Figure 6:
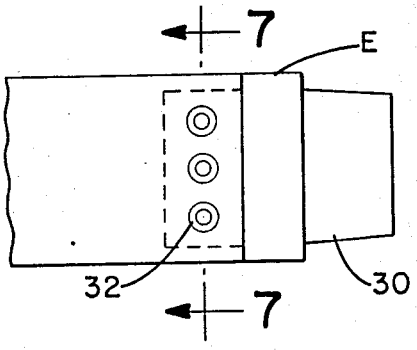
FIG. 6 is a side view of a coupling adapter end E of FIG. 3.

FIG. 6 shows the male end E of a straight member 20, as shown in FIG. 3. The male end is comprised of coupling adapter 30, inserted into the end of the member and fastened by means of rivets 32. The method of affixation can also vary if desired, for example, adhesives and other forms of fasteners could also be used effectively.

Figure 7:
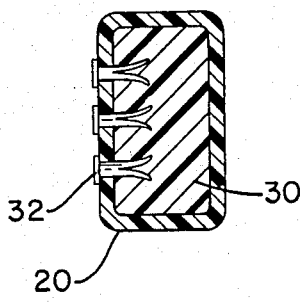
FIG. 7 is a transverse section through 7—7 of FIG. 6.

FIG. 7 illustrates a sectional view of FIG. 6 along line 7—7 showing details of the affixation of coupling adapter 30 to straight member 20 by means of rivets 32. Expandable rivets inserted into pre-drilled holes are particularly effective in the preferred embodiment of the invention.

Figure 8:
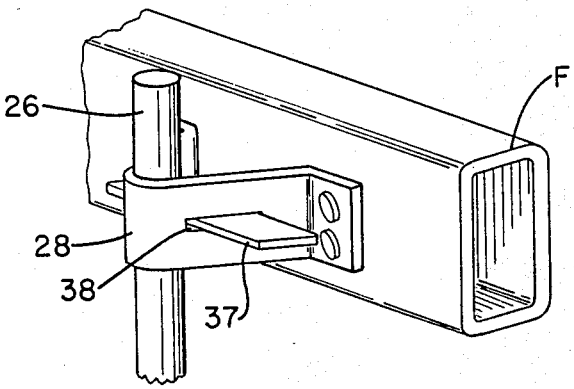
FIG. 8 is a perspective view of the female end F of FIG. 3.

FIG. 8 shows the female end F of FIG. 3 and details of the stake bracket 28 which illustrates in the preferred embodiment how a steel stake 26 is driven through the bracket and locked into place by means of a wedge shaped steel piece 37 forced through slots 38 of the bracket.

Figure 9:
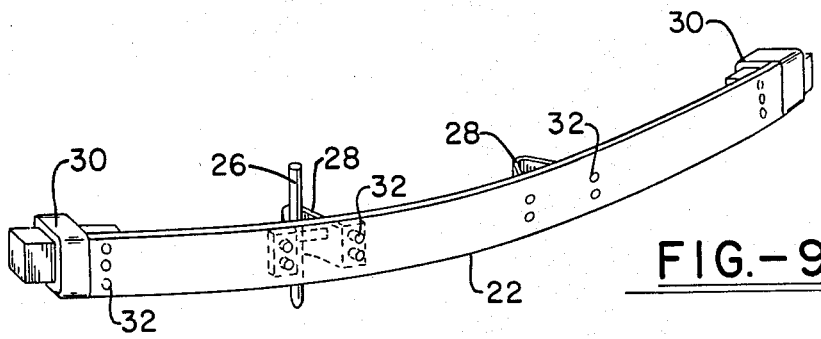
FIG. 9 is a perspective view of a radius form member.

FIG. 9 is a perspective view of a radius form member 22 showing coupling adapters 30 fastened to each end of the member with rivets 32, and stake brackets 28, also fastened with rivets 32. As in the case of the straight form members, the number and type of the brackets can vary, as can their method of affixation.

Figure 10:
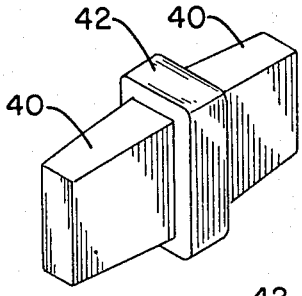
FIG. 10 is a perspective view of a coupling adaptor.

FIG. 10 shows a perspective of a coupling adapter having two male ends 40, and a shoulder portion 42. In the preferred embodiment and as shown, the male ends have a slight taper both horizontally and vertically, to facilitate their disposition in the female ends of components. The shoulder portion 42 is designed to protrude outward from the male portions of the adapter sufficiently far to form a substantially smooth continuous surface when assembled with the other components of the forming device.

Many different materials may be used to fabricate the coupling adapters. It has been found to be particularly useful to use molded plastic materials, however, such as synthetic thermosetting resins, including polyester resins and high impact synthetic thermoplastic resins. Advantageously, short fiberglass fibers can be incorporated in the chosen resin for reinforcing purposes. Reinforcing rods can also be deployed in the resin for the same purpose.

In the preferred embodiment, the coupling adaptor is a mold cast of a polyester resin such as the WDL292, a resin manufactured by the Silmar Division of Vistron Corporation, containing small resin conserving bubble voids formed, for example, from calcium carbonate and reinforced with about 10 percent by weight of short fiberglass fibers less than about $\frac{1}{4}$ inch in length, more preferably 1/32 inch in length. Also disposed in the coupling adapter of the preferred embodiment are pultruded, resin bound fiberglass rods of small diameter, typically of $\frac{1}{4}$ inch to $\frac{3}{4}$ inch diameter. It is to be understood, however, that the invention may be practiced irrespective of the presence or absence of reinforcing fibers and rods, their composition, their configuration, and their quantity.

Figure 11:
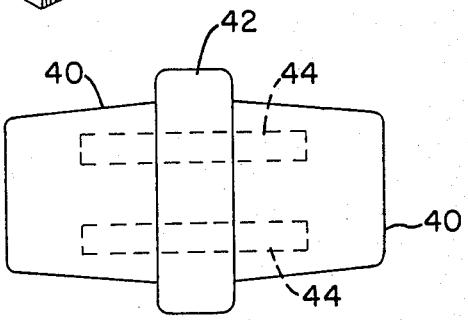
FIG. 11 is a plan view of a coupling adapter.

FIG. 11 is a plan view of the coupling adapter of FIG. 10 showing reinforcing rods 44 disposed in the adapter for reinforcing purposes.

Figure 12:
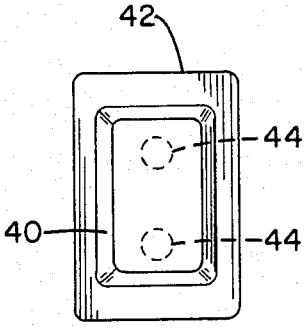
FIG. 12 is an end view of a coupling adapter.

FIG. 12 is an end view of FIG. 11 also showing placement of the reinforcing rods 44.

Figure 13:
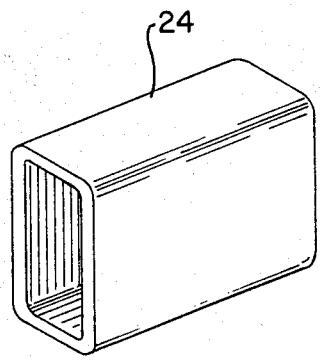
FIG. 13 is a perspective view of a radius coupler.

FIG. 13 is a perspective view of a radius coupler 24 which comprises a hollow rectangular plastic tube adapted for insertion in the male ends of a coupling adapter.

The components of the forming device comprising the coupling adapter, the straight form and the radius form, can be made from many different plastic materials, such as polyvinylchloride, polypropylene, polyethylene and others. It has been found that synthetic thermosetting resins are particularly adapted to the purpose of the invention, as are epoxy resins.

In the preferred embodiment of the invention, such components are pultruded into the desired shape from a combination comprising an isophthalic polyester resin reinforced with flat, continuous strand fiberglass mats and with continuous fiberglass roving. A combination of about 55 percent by weight of resin, with about 45 percent by weight of reinforcing, has been found to be particularly useful.

Figure 14:
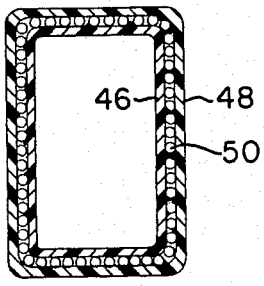
FIG. 14 is a cross section of the preferred embodiment of a straight member.

FIG. 14 illustrates a cross sectional view of a straight member of the preferred embodiment, exaggerated to show the course resin soaked fiberglass mats 46, the finer mats 48, and the roving 50.

In an especially preferred embodiment, the outside of the form components, the surfaces which are exposed to the concrete, are made from very fine, high end continuous strand, glass mats that incorporate relatively large amounts of a low profile additive in the resin to minimize shrinkage of the resin in the interstices of the mat. Both the fineness of the fibers and the additive minimize the size of the depressions between fiberglass strand components to produce an unusually smooth surface which greatly reduces adhesion tendencies of the concrete. Also added to the resin is a mold release component which further significantly reduces the tendency of the concrete to adhere to the forming device.

In practice, it has been found desirable to use as the outer layer of the continuous strand glass matting, a material such as "A glass", made by companies as for example, Nico Fibers Company, comprising randomly disposed swirl patterns of fiberglass fibers incorporated in a thermosetting resin binder. The fiberglass used in the matting is of a fineness such that the weight of the mat is no more than about ½ ounce per square foot of mat. The outer layers are to be distinguished from the inner layers of matting in that the fibers are of larger diameter for strength purposes and fewer in number. They comprise, for example, products such as "E glass", made by companies including Owens Corning Fiberglass Corporation. They are of similar construction as the A glass, but weigh up to about 1½ ounces per square foot of mat.

The low profile additives reduce resin shrinkage by substantial amounts, for example, up to about 7 percent. Such additives comprise thermoplastic materials such as powdered low density polyethylene, polyvinyl acetate, and the like. They can be used in amounts of 3 percent to 25 percent by weight of the resin, but more advantageously from 5 to 10 percent by weight, since resin physical properties experience increasing impairment at higher levels of use.

Mold release agents found beneficial include materials such as zinc stearate, phosphate esters, and the like, and are used in the amount of about ½ to 1½ percent by weight of resin, with the use of about 1 percent being particularly beneficial.

In addition to a catalyst, the resin may also contain ingredients including fillers such as, for example, alumina silicate, and others. If desired, the interior of the form components may be reinforced by being filled with a reinforcing substance such as wood, foamed materials, for example polystyrene, polyurethane and the like.

The dimension of the form components, including their height, width and length, may all be varied to meet the conditions of use. It has been found convenient to have the height approximate the height of the concrete slab being formed. The width will usually be adjusted to assure adequate strength, and the length will depend on factors such as the size of the concrete slab being formed, as well as the considerations such as ease of handling. Heights of the forms of about 4 to 24 inches are common. Widths of radius forms range from about ⅛ inch to about 1 inch, and straight form and coupler widths are from about 1 inch to 6 inches. Straight form lengths commonly employed range from 10 to 12 feet, and radius form lengths from 6 to 12 feet.

Form members may also have any combination of ends, male, female or both.

While in accordance with the patent statutes, a preferred embodiment and best mode has been presented, the scope of the invention is not limited thereto, but rather is measured by the scope of the attached claims.

What is claimed is:

1. A concrete forming device comprising at least one bendable elongate radius form member having a substantially thin, flat cross section, coupling adaptors comprising an elongated component having two male ends, with a shoulder therebetween, one male end of each adaptor being fastened to a respective end of said at least one radius form member such that said shoulder of each adaptor is smoothly continuous with a concrete forming surface of the at least radius form member, and at least one elongate concrete form member having at least one rectangular shaped open end, the other one of said male ends being insertable into said rectangular tube-shaped open end of said concrete form member and wherein the surface of said shoulder is smoothly continuous with the exterior surface of said concrete form member into which said male end is inserted.

2. A concrete forming device according to claim 1 wherein said radius form member has at least one bracket permanently attached to a side thereof, said bracket being adapted to have a stake driven therethrough.

3. A concrete forming device according to claim 1 wherein at least some of said members have at least one bracket permanently attached to a side thereof opposite to the concrete forming surface, said brackets being adapted to have stakes driven therethrough.

4. A concrete forming device comprising a straight form member having a shape of a straight rectangular tube and having a male end of a coupling adaptor inserted into at least one rectangular open end thereof, wherein said coupling adaptor comprises an elongated component having two male ends, with a shoulder therebetween, wherein the surface of said shoulder provides a monoplanar surface with a concrete forming surface of said straight form member into which said male end is inserted, and wherein further said rectangular tube is formed from a lamination comprising continuous fiberglass roving oriented parallel to the longitudinal axis of said rectangular tube, said roving being positioned between a layer forming the inside of said rectangular tube and a layer forming the outside of said rectangular tube, said layers comprising continuous strand glass matting, and said matting and said roving being bound together with a plastic resin.

5. A concrete forming device which includes a plurality of the straight form members according to claim 4.

6. A concrete forming device according to claim 4 wherein said straight form members have at least one bracket permanently attached to a side thereof, said bracket being adapted to having a stake driven therethrough.

7. A concrete forming device according to claim 5 wherein at least some of said straight form members have at least one bracket permanently attached to a side thereof opposite to the concrete forming surface said brackets being adapted to have stakes driven therethrough.

8. A concrete forming device comprising a coupling member having the form of a straight rectangular tube with two open ends, a coupling adaptor comprising an elongated component having two male ends, with a shoulder therebetween, an open end of said coupling member receiving one male end of said adaptor wherein the surface of said shoulder provides a monoplanar surface with a concrete forming surface of said coupling member into which one of said male ends is inserted, and wherein further, said rectangular tube is formed from a lamination comprising continuous fiberglass roving oriented parallel to the longitudinal axis of said rectangular tubing, said roving being positioned between a layer forming the inside of said rectangular tube and a layer forming the outside of said rectangular tube, said layers comprising continuous strand glass matting, and said matting and said roving being bound together with a plastic resin.

* * * * *